United States Patent [19]

Cohn

[11] 4,430,188

[45] Feb. 7, 1984

[54] ELECTRODES FOR USE IN AN ELECTROLYTIC PROCESS

[75] Inventor: Johann G. E. Cohn, West Orange, N.J.

[73] Assignee: Engelhard Corporation, Iselin, N.J.

[21] Appl. No.: 452,358

[22] Filed: Dec. 22, 1982

Related U.S. Application Data

[63] Continuation of Ser. No. 188,166, Sep. 17, 1980, abandoned.

[51] Int. Cl.[3] ..... C25B 11/10

[52] U.S. Cl. ..... 204/290 F; 204/297; 204/293; 502/101

[58] Field of Search ..... 204/290 F, 291, 293; 252/425.3

[56] References Cited

U.S. PATENT DOCUMENTS

| | | | |
|---|---|---|---|
| 2,928,778 | 3/1960 | Heathfield et al. | 204/293 X |
| 3,338,728 | 8/1967 | Hilton et al. | 501/904 X |
| 3,632,498 | 1/1972 | Beer | 204/290 F |
| 3,852,175 | 12/1974 | Hoehde | 204/98 |
| 3,862,023 | 1/1975 | Johnson | 204/290 F |
| 3,887,446 | 6/1975 | McEwan et al. | 204/86 |
| 3,926,844 | 12/1975 | Benzcur-Urmossy | 252/432 |
| 4,005,004 | 1/1977 | Seko et al. | 204/290 F |
| 4,011,373 | 3/1977 | Kaun et al. | 429/218 |
| 4,108,745 | 8/1978 | Cipris et al. | 204/129 |
| 4,288,302 | 9/1981 | DeNora et al. | 204/105 R |

*Primary Examiner*—F. Edmundson

[57] ABSTRACT

An electrode for use in an electrolytic reaction in an electrolytic cell, such as an anode in the manufacture of chlorine or hypochlorites, or the production of organic compounds or the electrolysis of water, comprises a valve metal base or substrate, at least a portion of the exposed surface of which has a thin electronically conductive, electrocatalytic matrix coating having a thickness effective for conducting sustained electrolysis, which coating, exclusive of any diluent or additives, is essentially amorphous and lacking essentially in crystallinity detectable by X-ray diffraction analysis; and electrolytic processes employing such an electrode.

2 Claims, No Drawings

ELECTRODES FOR USE IN AN ELECTROLYTIC PROCESS

This is a continuation of application Ser. No. 06/188,166 filed Sept. 17, 1980, now abandoned, which was a continuation-in-part of U.S. Ser. No. 915,105 filed June 13, 1978 now abandoned and relates to electrodes for electrolytic processes, to processes employing such electrodes, and to electrolytic cells employing such electrodes.

It is known to employ in electrolytic processes electrodes comprising a thin film of an oxide of a platinum-group metal coated on to a substrate comprising a "film-forming metal"; see U.S. Pat. Nos. 3,632,498; 3,977,958 and 3,611,385. It is also known to employ a coating on a valve metal comprising, in addition to an oxide of a platinum-group metal, carbides of boron, hafnium, chromium, molybdenum, tantalum, titanium, tungsten, and the like, and also refractory oxides such as silica, titania, etc.; see U.S. Pat. Nos. 3,616,329; 3,654,121; 3,657,102; 3,677,815; 3,687,724 and 3,755,107, and also the papers presented at the May 1978 meeting in Seattle of the Electrochemical Society.

It has now been discovered that electrodes for use as anodes in electrolytic processes of the nature referred to in the patents identified in the preceding paragraph, for the manufacture of chlorine, hypochlorites, chlorates and perchlorates, the production of organic compounds, the electrolysis of water, and cathodic protection systems, may be advantageously made by coating at least a portion of the valve metal surface of a base (or substrate) with at least one coating of a thin, electronically-conductive, electrocatalytic matrix coating material having a thickness effective for conducting electrolysis, wherein such matrix coating, exclusive of any binder or modifier which may be incorporated thereinto, is essentially amorphous and essentially lacking in crystallinity detectable by X-ray diffraction analysis. The electrode has the advantages of a long life in an electrolysis environment and a low over-voltage.

For purposes of the present invention, the terms "Electrocatalyst" and "Electrocatalytic" shall be in general accordance with the definition as found in the article entitled "The Electrocatalyst Problem In The Direct Hydrocarbon System", authored by H. A. Liebhafsky; Proceedings 20th Annual Power Source; page 1, May 24–26, 1966, PSC Publications Committee.

The electrode of this invention comprises a base (or substrate) which has a surface comprising essentially a valve metal. As employed herein, the phrase "valve metal" has the same meaning attributed to it in the prior art, including the prior art referred to hereinabove, and includes, illustratively, titanium, tantalum, tungsten, aluminum, hafnium, niobium, or zirconium, including alloys thereof. The base (or substrate) may be a homogeneous body having such a valve metal surface, or it may comprise an electrically conductive base metal, such as copper, which has superior properties as an electrical conductor but which is subject to corrosion in an electrolysis environment, bearing a separate adherent coating of a valve metal.

The matrix coating may comprise one or more layers of several classes as described in greater detail hereinafter, of essentially amorphous, electronically conductive electrocatalytic materials which are essentially lacking in crystallinity detectable by X-ray diffraction analysis.

The invention also includes electrolytic cells, and electrolytic processes conducted by, employing the electrodes described herein.

A first class of amorphous matrix coating materials is phases (as that word is employed in this technology) comprising predominantly at least one element from Group IIIa and at least one element of Group Va of the Periodic Table of the elements as published in the Handbook of Chemistry & Physics (55th Edition, CRC Press, 1974). Such first class of matrix coating material may also contain a second or third element of either or both of Groups IIIa and Va. Illustrative compositions of this class containing only one element from each such Group include systems comprising aluminum-antimony, gallium-antimony, indium-antimony, gallium-arsenic, indium-arsenic, gallium-phosphorus, indium-phosphorus, aluminum-phosphorus, aluminum-arsenic, boron-containing compounds, particularly boron phosphorus, such as boron-phosphide, BP and boron-nitride, BN. (The phrase "comprising predominantly" as employed herein when characterizing the elements constituting the various classes of amorphous matrix coating materials means that the elements from the enumerated Groups constitute more than 50 atomic percent of the amorphous matrix coating material, and admits of the inclusion of a minor amount, less than 50 atomic percent, of other elements, provided that the matrix coating material exclusive of any binder or modifier as described hereinafter is electronically conductive, electrocatalytic and lacking in crystallinity detectable by X-ray diffraction analysis.)

Compositions illustrative of phases of the first class which comprise a plurality of elements from either Group IIIa or Group Va include indium-gallium-antimony, gallium-arsenic-phosphorus, indium-arsenic-antimony and gallium-arsenic-antimony.

Illustrations of semiconducting materials corresponding in composition to those referred to above, and also additional examples of other compositions, are described in "Semiconductors," by R. A. Smith, Cambridge University Press, 1959, at pages 392 and 409; and also in The Proceedings of the International Symposium on Chemical Bonds in Semiconducting Crystals, held at Minsk, U.S.S.R., 1967, in Vol. 4, entitled "Semiconductor Crystals, Glasses and Liquids," at pages 49, 95 and 155 (English translation by the Consultants Bureau, New York-London, 1972) (hereinafter referred to as "Semiconductor Crystals, Glasses and Liquids"). The disclosures of the foregoing references and the references cited hereinafter in respect of materials having electronic conductivity are hereby expressly incorporated hereinto by reference.

A second class of amorphous matrix coating materials is phases comprising predominantly at least one element from Group II and at least one element of Group VIa of the Periodic Table which is solid at standard conditions. This second class of matrix coatings may also contain a second or third element of either or both of Groups II or VIa. Illustrative compositions of this class include phases comprising predominantly zinc-selenium, beryllium-selenium, beryllium-sulfur, beryllium-tellurium, zinc-sulfur, cadmium-sulfur, cadmium-tellurium, cadmium-selenium. Additional illustrations of semiconducting materials having compositions corresponding in type to those of the second class of phases are disclosed in "Semiconductors" by Smith, at pages 413–34, and in "Bands and Bonds in Semiconductors" by J. C. Phillips, at page 196 (Academic Press, New York and London, 1973).

A third class of amorphous matrix coating materials is phases comprising predominantly at least one element from Group IIa and at least one element from Group IVa (excluding carbon of the Periodic Table. The third class of matrix coatings may also contain a second or third element of either or both Groups. Illustrative compositions of this class include magnesium-tin, calcium-germanium, calcium-tin, calcium-silicon, calcium-lead, magnesium-silicon and magnesium-germanium, in which there are nominally two atoms of the Group IIa element per atom of the Group IVa element. Information regarding semiconducting materials having compositions corresponding to those referred to above is available on pages 411–412 of "Semiconductors" by Smith.

A fourth class of amorphous matrix coating materials is ternary phases comprising predominantly at least one element of each of Group II, Group IV and Group Va of the Periodic Table. They are sometimes referred to as $A^{II}B^{IV}C_2^{V}$ compounds which are nitrides, phosphides, arsenides and antimonides. Illustrative of the fourth class of compounds in which the atomic ratio of the atoms of Groups II: IV: Va is nominally 1:1:2 are nitrides such as zinc-tin-nitride, zinc-germanium-nitride, and calcium-silicon-nitride; phosphides such as beryllium-tin-phosphides, cadmium-germanium-phosphides; antimonides such as zinc-tin-antimonide, zinc-germanium-antimonide and cadmium-germanium-antimonide; and arsenides such as zinc-tin-arsenide, magnesium-silicon-arsenide, cadmium-tin-arsenide and magnesium-tin-arsenide. Illustrative ternary phases of the fourth class in which the atomic ratio of the elements varies from that stated above include $Ca_4SiN_4$ and $Ca_5Si_2N_6$. Additional information regarding semiconducting materials having ternary compositions corresponding in type to the ternary compositions referred to above is available at pages 31–38, 55–59 and 88 of "Semiconductor Crystals, Glasses and Liquids."

A fifth class of amorphous matrix coating materials is ternary phases comprising predominantly at least one element, normally solid at standard conditions, from each of Groups II, V and VI of the Periodic Table excluding oxygen. Such fifth class of matrix coating materials may also contain additional elements from either or both of Groups II and V. Phases of the fifth class are sometimes identified as $A_3^{II}B_2^{V}$-$A^{II}C^{VI}$ phases. Illustrative compositions of the fifth class of amorphous matrix coating materials are $Zn_3As_2$-2 ZnTe; $Zn_3As_2$-2 CdTe; $Cd_3As_2$-2 CdTe; $Cd_3P_2$-2 CdTe; $Cd_3As_2$-2 CdSe and $(Zn,Cd)_3(P,As)_2$-2 (Zn,Cd)(S,Se,Te). Additional ternary phases of the fifth class include $Hg_3PS_4$, $Hg_3PS_3$, $Hg_4P_2S_7$ and $HgPS_3$. Information regarding semiconducting materials having ternary compositions corresponding to the ternary compositions referred to above is available at pages 69–72 and 97–103 of "Semiconductor Crystals, Glasses and Liquids".

A sixth class of amorphous matrix coatings is ternary phases comprising predominantly at least one element from each of Groups Ib or IIb together with at least one element of each of Groups IIIa and VIa, excluding oxygen. Such sixth class of matrix coating materials may also contain additional elements from each such group. Phases of the sixth class which comprise elements from Group Ib are sometimes denoted as $A^{I}$-$B^{III}C_2^{VI}$. Illustrative compositions of this type are $AgInTe_2$, $AgGaTe_2$, $CuInTe_2$, $AgInTe_2$, $AgGaS_2$, $CuInS_2$, $CuAlS_2$, $AgAlSe_2$, $CuAlSe_2$, $CuInSe_2$ and $AgInSe_2$. Additional amorphous materials of the sixth class are sometimes denoted as $A^{I}B_5^{III}C_8^{VI}$, for instance, $CuIn_5Te_8$, $AgIn_5Te_8$ and $AgIn_5Se_8$. When a Group IIb element is employed instead of a Group Ib element, the phases are sometimes denoted as $(A^{II}C^{IV})$-$(B_2^{III}C_3^{VI})$, such as $ZnS$-$In_2S_3$ and $CdS$-$In_2S_3$. Information regarding semiconducting materials having compositions corresponding to those referred to above is available at pages 31–38 and 73–77 of "Semiconductor Crystals, Glasses and Liquids" and at page 437 of Smith's "Semiconductors".

A seventh class of amorphous matrix coating materials is quaternary phases comprising predominantly at least one element of each of Groups II, III, V and VI(a), excluding oxygen, of the Periodic Table and they also may comprise a plurality of elements from any single group. Illustrative phases of the seventh class include InAs–CdS; InAs–CdSe; InAs-CdTe; InAs-ZnSe; InAs-ZnTe; and InAs-ZnS. Information regarding semiconducting materials having compositions corresponding to those referred to above is available at pages 104–107 of "Semiconductor Crystals, Glasses and Liquids".

An eighth class of amorphous matrix coating materials is quinary phases comprising predominantly at least one element from each of Groups I, III, IV, V and VIa of the Periodic Table excluding oxygen. These are understood to be compositions of $B^{III}D^{V}$ compounds with $A_2^{I}C^{IV}E_3^{VI}$ compounds having a general formula $A_{(0.5x+0.5y)}^{I}B_{(0.5-1.5x-0.5y)}^{III}C_x^{IV}D_{(0.5-y)}^{V}E_y^{VI}$. Illustrative compositions of this phase include up to 40 mol percent of $Cu_2GeSe_3$ combined with 3 GaAs; and about 1% of the former combined with either 3 InSb or 3 GaSb and about 1% $Ag_2GeSe_3$ combined with 3 GaSb. Additional information regarding semiconducting materials having compositions corresponding to those referred to above is described at pages 81–85 of "Semiconductor Crystals, Glasses and Liquids".

A ninth class of amorphous matrix coating materials is phases comprising predominantly chalcogenide glasses. These containing, for instance, elements from Groups IIIa, IVa, Va and VIa, excluding oxygen, are known in the art, for which see illustratively U.S. Pat. No. 3,271,591, which discloses as chalcogenides $Ge_{0.17}Te_{0.83}$ and $Ge_{0.15}Te_{0.81}Sb_{0.02}S_{0.02}$; U.S. Pat. No. 3,876,985, which discloses specifically $Ge_{0.075}Te_{0.675}As_{0.25}$; $Ge_{0.0675}Te_{0.40}As_{0.35}Si_{0.18}In_{0.002}$; and $Ge_{0.155}Te_{0.28}As_{0.34}S_{0.22}$; and the compositions $Te_{0.50}As_{0.52}$ and $As_{0.38}Ge_{0.14}Te_{0.43}S_{0.05}$, which are disclosed by S. Marsand, INIS Atomindex, Vol. 8, (23) (1977) referred to in Chemical Abstracts, Vol. 88, at No. 114203. The composition $Si_{11}Ge_{11}As_{35}P_3Te_{40}$ is disclosed in the Proceedings of the Symposium on Semiconductor Effects in Amorphous Solids, at page 172 (North-Holland Publishing Co., Amsterdam, 1970). Compositions of sulfur with titanium, vanadium, chromium, manganese or zirconium have been described in U.S. Pat. No. 3,571,669. Additional chalcogenide glasses as described in "Semiconductor Chrystals, Glasses and Liquids" at pages 131–143. Chalcogenide glasses comprising rare earths are referred to at pages 39–44 thereof, and by V. P. Zhuze, et al., Fiz, Tverd. Tela. Vol. 6, pages 257 and 268 (1964). Additional chalcogenide glasses are disclosed in the Proceedings of the Symposium on Semiconductor Effects in Amorphous Solids, at page 372 (North-Holland Publishing Co., Amsterdam, 1970).

A tenth class of amorphous matrix coating materials comprises predominantly amorphous alloys of metallic elements from Groups IV, Vb, VIb and the rare earth metals with each other or with a metal from Group Ib or Group II or the base metals of Group VIII. Illustrative materials of the tenth class include an alloy of 30–85 atomic percent nickel in niobium (for which see T. W. Barbee, et al., Thin Solid Films, Vol. 45(3), page 591 (1977)); alloys of silver and a rare earth element such as gadolinium, terbium, dysprosium, holmium or erbium (for which see B. Boucher, IEEE Trans. Magn., 1977 MAG-13(5), 1601 (English)); alloys of cobalt and gadolinium (for which see O. S. Lutes, et al., id. at page 1615); alloys of the composition $Ge_xTe_{(1-x)}$ where x is in the range of 0.1 to 0.9, advantageously 0.5 or 0.6 (for which see S. K. Behal, et al., Thin Solid Films, Vol. 48(1), page 51 (1978)); and alloys of magnesium with either bismuth or antimony.

An eleventh class of amorphous matrix coating materials comprises predominantly borides, carbides, nitrides, silicides and phosphides some of which are known as metallic glasses, such as $Fe_{80}B_{20}$ and $Fe_{78}Mo_2B_{20}$, and compositions which correspond to semiconductors described at pages 8–26 and 55–59 of "Semiconductor Crystals, Glasses and Liquids", such as $Ca_3N_2$, $CaSiN_2$, $Si_3N_4$, $Mn_{(1.67-1.75)}Si$ and CrSi. Other suitable amorphous compositions are formed from phosphorous with silicon, germanium, gallium, boron or aluminum, as referred to in U.S. Pat. No. 3,571,673; boron with rare earth metals, as described in U.S. Pat. No. 3,571,671; and boron with carbon, silicon, titanium, germanium, zirconium and hafnium, as referred to in U.S. Pat. No. 3,571,670.

It should be understood that compositions of the various elements included within the foregoing classes which are crystalline (and some such compositions can be prepared in the crystalline form) are not embraced by the phrases "amorphous matrix coating" or "amorphous matrix coating materials" as those phrases are employed herein.

Amorphous coatings made from the classes referred to above may and normally do also include varying amounts of one or more modifiers. The inclusion of a modifier has a profound effect on the properties of the basic amorphous matrix material in respect of its electrical and electronic properties and its electrocatalytic activity. By incorporating a modifier, the electrical conductivity of the matrix can be varied by a few to several orders of magnitude.

The purpose of incorporating "dopants" into semiconducting materials to achieve the desired electronic states and electrical conductivity is well known in the art and is, for instance, discussed in "Semiconductors" by Smith. However, in contrast to conditions obtaining with crystalline semiconductors, e.g., with transistors, where the chemical purity of the base material and the chemical purity and the permissible variation of the concentration of the dopant must meet stringent requirements, the purity requirements and the concentration of a modifier are considerably less critical for the performance of amorphous electrode coatings. Relatively large ranges of modifier concentrations may be employed to vary the properties of the matrix. In general, the concentrations of the modifier in the amorphous matrix for use as effective coatings on valve metal electrodes may vary from less than 1 atomic percent to about 30 atomic percent of the amorphous matrix.

As employed herein, the term "modifier" is employed to mean an element which is non-gaseous at standard conditions, or a compound thereof, which element is not within the definition of the class of phase which comprises the matrix, and which element, or a compound of it, as it exists within the matrix is a solid and is essentially water insoluble. Suitable modifiers include metals, and compounds thereof, of Group Ib, Group II, Group IV, rare earth metals and the transition metals of Groups IVb, Vb, VIb, VIIb and the base metals (iron, cobalt nickel) of Group VIII. Carbon and boron may also be employed as modifiers.

The modifiers are either uniformly or homogeneously distributed within the matrix in order to obtain the desired modification of the electrical conductivity and electrocatalytic properties. The modifiers may be present in either the amorphous state, or in a highly dispersed microcrystalline form.

A binder such as Teflon may optionally be included in the amorphous matrix coating material to increase adhesion of the coating to the surface of the base of the electrode. A binder, if any, should be selected to avoid any adverse influence of it on the electronic conductivity and electrocatalytic properties of the class of amorphous material with which it is employed, and typically the binder comprises a small fraction of the amorphous matrix coating material.

Amorphous matrix coating materials may be applied to the valve metal by any of several known techniques. In the slurry method, the material to be applied is dispersed in an aqueous or organic liquid in the form of finely comminuted particles having an average particle size of less than about 250 microns, and preferably in the range of about 10 microns to colloidal particles. The slurry is applied to the valve metal substrate by painting, brushing, spraying or dipping, and thereafter the electrode in process is dried, fired in air at a temperature of about 200° to about 800° C. and optionally up to about 1200° C., or in an atmosphere inert to the substrate and the coating material, or in a vacuum. Optionally, suitable binding agents may be incorporated in the slurry, for example, organometallic compounds such as resinates of bismuth, tin, titanium or uranium as taught in U.S. Pat. No. 3,687,724. The organometallic compounds decompose during the firing step, usually to the metal oxides, and then act as diluent binding agents. A second process of application involves the application of organometallic compounds such as resinates, mercaptides or carboxylates dissolved in an organic solvent. The solution is applied to the surface of the valve metal and then the organometallic compound is decomposed to the elemental metal by firing at temperatures in the range of about 200° to about 800° C. in an atmosphere of hydrogen which is essentially free from oxidizing compounds such as gaseous oxygen. This method of application is preferred for carbides. A third process of application if by vacuum evaporation or sublimation and subsequent deposition of the coating material on to the valve metal substrate. Additional processes of application are sputtering, such as radio-frequency sputtering, or by glow discharge of the material onto the valve metal surface. In general, sputtering is the preferred process of application.

The average thickness of the amorphous matrix coating, including any binder or modifier, should be sufficient to permit sustained electrolysis, and is preferably in the range from about 100 Angstroms to about one millimeter. The amorphous matrix coating may cover substantially all of the exposed anodic surface of the valve metal or as little as 20 percent of such surface, but advantageously, and depending in part upon economics, may cover in the range from about 80 percent to about 95 percent of such surface.

The electrodes described herein may carry one or a plurality of layers of amorphous matrix coating material. The outer layer should be electronically conductive and electrocatalytic, as well as being resistant to the electrolysis environment in which it is employed. An inner layer, if it is employed, should be electrically conductive but need not be electrocatalytic. The layers may comprise phases of the same or different or alternating classes of amorphous material. Each layer should adhere to any underlying layer or to the surface of the valve metal surface of the substrate.

The currently preferred embodiment of this invention is an electrode comprising a substrate having a titanium surface having an amorphous matrix coating comprising predominantly a chalcogenide glass, or alternatively boron phosphide, and a modifier.

Having thus described the invention, what is claimed is:

1. An electrode for use in an electrolytic reaction, said electrode comprising a base having a surface of a valve metal, at least a portion of said surface having a thin, electronically conductive, electrocatalytic coating having a thickness effective for conducting electrolysis, said coating comprising a matrix and a modifier, and said matrix, exclusive of any binder or modifier, being essentially amorphous and essentially a chalcogen glass comprising germanium-tellurium.

2. An electrode according to claim 1, wherein said chalcogenide glass is germanium-phosphorus-tellurium.

* * * * *